United States Patent [19]

Zuckler

[11] Patent Number: 4,504,711

[45] Date of Patent: Mar. 12, 1985

[54] VACUUM SWITCHING TUBE HAVING MAGNETIC FIELD ELECTRODES

[75] Inventor: Karl Zuckler, Berlin, Fed. Rep. of Germany

[73] Assignee: Siemens Aktiengesellschaft, Munich, Fed. Rep. of Germany

[21] Appl. No.: 467,806

[22] Filed: Feb. 18, 1983

[30] Foreign Application Priority Data

Feb. 23, 1982 [DE] Fed. Rep. of Germany ..... 3206823

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,764,764 | 10/1973 | Takasuna et al. | 200/144 B |
| 4,117,288 | 9/1978 | Gorman et al. | 200/144 B |
| 4,196,327 | 4/1980 | Kurosawa et al. | 200/144 B |
| 4,336,430 | 6/1982 | Kurosawa et al. | 200/144 B |

FOREIGN PATENT DOCUMENTS

| | | | |
|---|---|---|---|
| 2038098 | 7/1980 | United Kingdom | 200/144 B |

OTHER PUBLICATIONS

"IEEE Transactions on Power Apparatus and Systems", vol. PAS-99, vol. 6, Nov./Dec. 1980, pp. 2079 to 2085.

*Primary Examiner*—Robert S. Macon

*Attorney, Agent, or Firm*—Kenyon & Kenyon

[57] ABSTRACT

A vacuum switching tube is disclosed which comprises two cooperating electrodes each of which includes an electrode body connected to a current conductor rod, a support plate and a contact. The electrode body comprises a ring through which a central bridge extends. Two raised sections are disposed on the ring diagonally opposite each other and offset 90° from the central bridge. The raised sections constitute current transfer points. The main contact is connected to the electrode body only at the raised sections. In the space between the main contact and the ring is disposed a support plate made of a non-magnetic and electrically poorly conducting or non-conducting material. The main contact is supported by a plurality of spacers to provide mechanical strength. The electrode described herein operates with a self-generated axial magnetic field and is particularly well suited for vacuum circuit breakers.

5 Claims, 8 Drawing Figures

VACUUM SWITCHING TUBE HAVING MAGNETIC FIELD ELECTRODES

BACKGROUND OF THE INVENTION

The present invention relates to a vacuum switching tube, particularly one having axial magnetic field electrodes.

A vacuum switching tube is disclosed in "IEEE Transactions on Power Apparatus and Systems", 1980, pages 2079 to 2085, which comprises a vacuum-tight housing and magnetic field electrodes disposed in the housing movable relative to each other. Each electrode is supported by a conductor rod and comprises a coil or field winding which includes a ring and two spokes extending diametrically through the ring at right angles to each other. Two raised parts on one of the spokes are provided adjacent the hub as current transfer points. A main contact is disposed entirely covering the ring and spokes. Operation of such magnetic field electrodes is based on the generation of an axial magnetic field which counteracts the contraction of partial arcs to form a spatially concentrated arc discharge. In contrast to a diffused discharge occurring at low currents, the concentrated arc is accompanied by a large anode spot and a relatively high operating voltage as well as by high power consumption, which leads to melting at the main contacts and heavy evaporation of material.

OBJECTS AND SUMMARY OF THE INVENTION

It is an object of the present invention to provide a vacuum tube having a magnetic field electrode of high mechanical strength and increased switching capacity.

The above and other objects are achieved by the invention disclosed herein according to which the current transfer points in a vacuum tube having a magnetic field electrode comprising a ring and a main contact disposed over the ring are disposed on the ring. The current transfer points project from the ring to the main contact and a support is disposed in the space between the ring and the main contact. The support is made of a mechanically strong, non-magnetic and electrically non-conducting or poorly conducting material.

The support reinforces the electrode without disturbing the current distribution required for generating the magnetic field or the magnetic field itself. Materials having suitable properties of which the support can be made include, for example, chrome-nickel steels. The position of the current transfer points at the periphery of the main contact, i.e. along the ring, leads to a largely uniform stress of the main contact area.

The support is preferably a plate and recesses are preferably provided in the support plate through which the raised current transfer points project. Because the current transfer points are located along the ring, the recesses may be open at the periphery of the plate and thereby can be made quite easily.

In principle, a wide area support can be provided between the ring, the support plate and the main contact. However, according to an aspect of the invention, a number of individual spacers of electrically non-conducting material are disposed between the main contact and the support plate and between the support plate and the ring. Such spacers provide electrical separation between the parts they separate and can be manufactured easily. Nevertheless, the support desired for the main contact can be obtained if the distribution and number of spacers are chosen accordingly.

The above and other objects, features, aspects and advantages of the present invention will be more readily perceived from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like numerals indicate similar parts and in which:

FIGS. 2, 4 and 6 taken together are an exploded top plan view of the electrode of FIG. 1, in which the structure depicted in FIGS. 2, 4 and 6 corresponds to that depicted in FIGS. 1, 3 and 5, respectively, and in which FIGS. 1 and 2 depict a main contact, FIGS. 3 and 4, a support plate, and FIGS. 5 and 6, the field winding including a ring and raised current transfer points;

DESCRIPTION OF THE PREFERRED EMBODIMENTS

Figure 1:
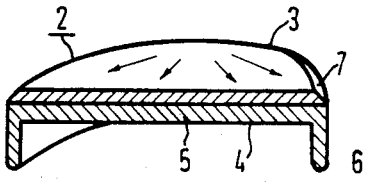
FIGS. 1, 3 and 5 taken together are an exploded perspective view, in axial section, of an electrode according to the invention.
Figure 3:
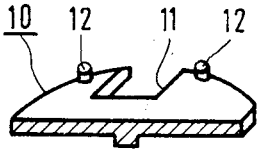
Figure 5:
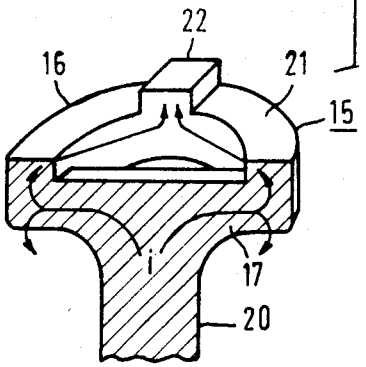
Figure 7:
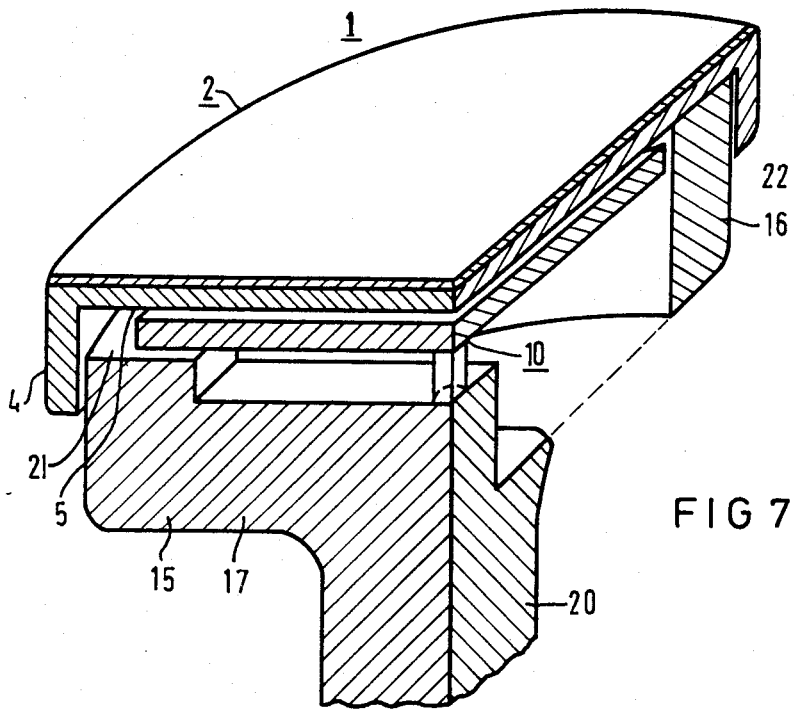
FIG. 7 is a perspective view in partial axial and radial cross-section of the electrode of FIGS. 1–6 in its assembled condition.

Referring first to FIGS. 1, 3 and 5, the inventive electrode depicted in those figures comprises an outer or main current contact referenced generally by 2 which includes a contact plate 3 having a contact area and being the contact-making element, and a support 4. The contact plate 3 may be made, for example, of a burn-up resistant contact material which is preferably used for vacuum switching tubes, for example, a composite chromium-copper material, or copper with added bismuth or tellurium. The support 4, on the other hand, is made of essentially pure copper and is shaped as a shallow cup. The bottom 5 of the cup is connected, for example by soldering, to the contact plate 3 and makes contact with the contact plate over a large area. The cup peripheral wall 6 facilitates centering of the main contact 2 on the electrode body 15 as depicted in FIG. 7 and described more fully below in connection with FIG. 5. The outside diameter of the support 4 corresponds to the diameter of the contact plate 3. The peripheral rim 7 of the contact plate 3 is beveled and rounded as shown in FIG. 1.

Below the support body 4 there is disposed a support plate 10 having a diameter smaller than the inside diameter of the support 4. The support plate 10 is provided at its periphery with two diagonally-oppositely-disposed cutouts 11 through each of which a current transfer point 22 extends in the assembled condition of the electrode 1. Four spacers 12 are distributed about the circumference of the support plate 10 on the top side thereof and also on the bottom side thereof, and a further spacer 12 is provided on the bottom of the support plate at the center thereof. The number and distribution of the spacers may differ from the specific arrangement described and illustrated and can be chosen according to the size of the electrode and the stress it is to be subjected to.

The support plate 10 is made of a mechanically strong material, in line with its supporting function, which is at the same time substantially electrically non-conducting and not ferromagnetic. Materials exhibiting these properties are, for example, chrome-nickel steels. Blocks of a ceramic material which are electrically non-conducting and exhibit high compression strength can suitably be used as the spacers.

While the support plate 10 is shown in FIG. 3 to be disc-shaped, the support plate can be of other configurations having high mechanical strength and low weight. For example, the support plate may be corrugated or have a waffle-like profile or be perforated or grid-like.

Figure 2:
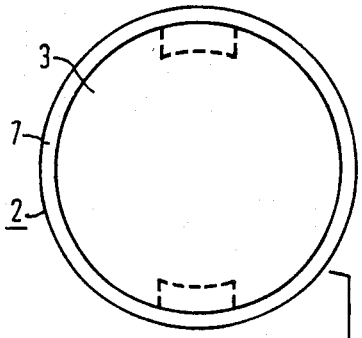
Figure 6:
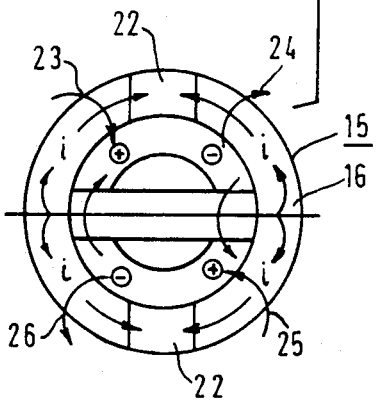

Referring to FIGS. 5 and 6, the conducting electrode body 15 comprises a ring-shaped portion 16 of rectangular cross section which is made integrally with a central bridge 17 and the current conductor rod 20. The electrode body however may also be made of individual pieces joined to each other, to which the current conductor rod is fastened. Two diametrically-oppositely-disposed raised sections 22 are provided on the planar face 21 of ring 17 facing the contact 2. The raised sections are current transfer points for the main contact 2. The diameter line on which the raised sections 22 lie is perpendicular to the longitudinal axis of the central bridge 17, as depicted in FIG. 6. Cutouts 11 are provided in the support plate 10 so that the raised sections extend directly to the support 4 of the main contact. Intermediate contacts between the two are not required, thereby providing a contactless passage. The contact areas of the raised sections 22 with the cup bottom 5 of the support 4 are shown in broken lines in FIG. 2.

Figure 4:
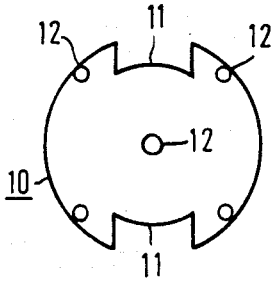

Referring to FIG. 7 in which the electrode is depicted in its assembled condition, the main contact is fastened, by soldering for example, to the raised sections 22 over a large surface area to insure that the main contact is securely fastened. Spacers 12 (FIGS. 3 and 4) are interposed between the face 21 of the ring 16 and the support plate 10, and also between the support plate 10 and the cup bottom 5 of the support 4 to maintain a predetermined spacing. The main contact 2 can therefore withstand, in spite of relatively thin-walled design, high forces which occur during interaction with an identical electrode in a vacuum switching tube.

The current distribution in the electrode during operation will be described in connection with FIGS. 1, 5 and 6. Referring to FIG. 5, current i entering the current conductor rod 20 is first divided into two equal partial currents which are conducted to the ring 16 via the central bridge 17. In the transition of each of the partial currents into the ring 16, a further division is obtained into two equal partial currents (FIG. 6) which flow in opposite directions through the ring 16 to the raised current transfers sections 22 where they are combined. Both partial currents then flow through the support 4 and the contact plate 3 to one or several base points of the switching arcs. The arc discharge is subjected to an axial magnetic field, the direction of which changes from one quadrant to the next, as shown by the arrows 23, 24, 25 and 26 in FIG. 6. Since the polarity of the magnetic field is different in the four quadrants of the ring 16, only a weak field is generated at the nulls or zero crossings, particularly near the axis of the electrode, and thereby the eddy currents are small. Consequently the charge carriers are weakly held at the nulls and can therefore be diffused largely unimpeded away from the space between electrodes. Other measures for suppressing the eddy currents, for example, slitting the support 4 or the contact plate 3 are therefore unnecessary.

If two identical electrodes constructed as depicted in FIG. 7 are arranged opposite each other in such a manner that the current flows through the mutually opposite rings quadrants in the same sense, attraction forces result. This is advantageous from a point of view of the switch drive because the contact-separating forces which occur during current surges are substantially smaller than in conventional electrode arrangements.

Figure 8:
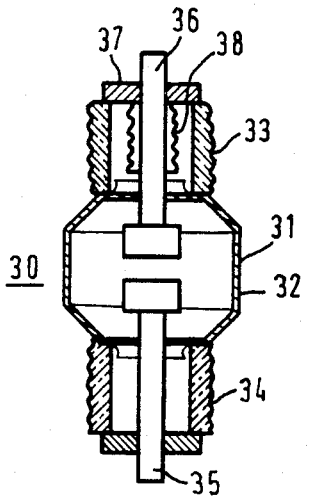
FIG. 8 is schematic axial section view of a vacuum switching tube having electrodes according to the invention.

Referring to FIG. 8, vacuum switching tube 30 includes two electrodes 1 according to FIG. 7 oppositely disposed in a housing 31 which includes a central metal section 32 and a hollow insulator 33, 34 connected to each side of the central section. The interior of the housing 31 is evacuated. While the lower electrode with its current conductor rod 35 is fixed, the upper electrode with its current conductor rod 36 can be moved in the axial direction for switching by spring bellows 38 disposed between the upper housing flange 37 and the current conductor rod 36.

Certain changes and modifications of the embodiments of the invention disclosed herein will be readily apparent to those skilled in the art. It is the applicant's intention to cover by his claims all those changes and modifications which could be made to the embodiments of the invention herein chosen for the purpose of disclosure without departing from the spirit and scope of the invention.

What is claimed is:

1. A switching tube comprising a housing, a pair of electrodes movably disposed relative to each other in the housing and respective current conductor rods supporting the respective electrodes, each electrode comprising:

(a) a field winding ring which includes:
  (1) a ring,
  (2) a bridge extending within the ring between inner peripheral locations thereof, and
  (3) a pair of raised sections disposed on the ring diametrically opposed from each other;
(b) a main contact; and
(c) a support plate made of non-magnetic and electrically low-conductivity material and disposed on the ring, the support plate having cutouts through which the respective raised sections extend to the main contact, the main contact being supported by the support plate and in contact with the raised sections.

2. The switching tube according to claim 1 and including spacers interposed between the main contact and the support plate and between the support plate and the ring.

3. The switching tube according to claim 1 wherein the main contact includes a main contact support of highly conducting material and a contact plate fastened thereto of a burnup-resistant material, the main contact support being supported by the support plate.

4. The switching tube according to claim 3 and including spacers interposed between the main contact support and the support plate and between the support plate and the ring.

5. The switching tube according to claim 1 wherein the two electrodes are identical and are arranged opposite each other such that respective sections of respective rings in which current flows in the same sense are in parallel.

* * * * *